US009073557B1

(12) United States Patent
Early

(10) Patent No.: US 9,073,557 B1
(45) Date of Patent: Jul. 7, 2015

(54) RAILCAR HATCH COVER ASSEMBLY

(71) Applicant: AERO TRANSPORTATION PRODUCTS, INC., Independence, MO (US)

(72) Inventor: Stephen R. Early, Olathe, KS (US)

(73) Assignee: AERO TRANSPORTATION PRODUCTS, INC., Independence, MO (US)

( * ) Notice: Subject to any disclaimer, the term of this patent is extended or adjusted under 35 U.S.C. 154(b) by 60 days.

(21) Appl. No.: 14/133,700

(22) Filed: Dec. 19, 2013

(51) Int. Cl.
*B61D 39/00* (2006.01)
*B61D 19/00* (2006.01)

(52) U.S. Cl.
CPC ..... *B61D 19/003* (2013.01); *B61D 19/001* (2013.01); *B61D 39/00* (2013.01)

(58) Field of Classification Search
CPC .... B61D 39/00; B61D 39/001; B61D 39/002; B61D 39/006; B61D 39/008
USPC ..... 105/377.01, 377.04–377.08
See application file for complete search history.

(56) References Cited

U.S. PATENT DOCUMENTS

| | | | | | |
|---|---|---|---|---|---|
| 4,077,329 | A | * | 3/1978 | Adler | 105/377.06 |
| 4,542,931 | A | * | 9/1985 | Walker, Jr. | 296/100.1 |
| 5,355,808 | A | | 10/1994 | Early | |
| 5,517,925 | A | | 5/1996 | Early | |
| 5,572,932 | A | | 11/1996 | Early | |
| 5,697,121 | A | * | 12/1997 | Early | 16/231 |
| 6,092,471 | A | | 7/2000 | Early | |
| 6,220,178 | B1 | * | 4/2001 | Jost | 105/355 |
| 6,250,233 | B1 | * | 6/2001 | Luckring | 105/377.01 |
| 6,352,036 | B1 | | 3/2002 | Early | |

* cited by examiner

*Primary Examiner* — R. J. McCarry, Jr.
(74) *Attorney, Agent, or Firm* — Stinson Leonard Street LLP

(57) ABSTRACT

A railcar hatch cover assembly having at least first and second covers each moveable between an open position and a closed position. First and second gears are mounted to the first and second covers, respectively. Third and fourth gears are mounted to a shaft that rotates between first, second, third, and fourth positions in sequence. The third gear is engaged with the first gear as the shaft rotates from the first position to the third position, and the fourth gear is engaged with the second gear as the shaft rotates from the second position to the fourth position. As the shaft rotates from the second position to the third position, the first cover assists in rotating the shaft and opening the second cover. The hatch cover assembly may have any number of covers, which as they move to an open position assist in the opening of another cover.

12 Claims, 5 Drawing Sheets

RAILCAR HATCH COVER ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention is directed toward a railcar hatch cover assembly, and in particular, to a railcar hatch cover assembly in which the opening of a cover assists in the opening of another cover.

2. Description of Related Art

Covered railcars have long been used to transport materials such as grain to keep them covered during transport. Such railcars typically have a series of openings, or a single opening, in the top of the railcar through which the grain may be loaded. One or more hatch covers are associated with the opening(s) to close and seal the opening(s) during transport. The hatch covers typically lay flat horizontally when in the closed position and have a pivot on one side that allows them to rotate approximately 180 degrees to lay flat, upside down, horizontally in the open position. When opening the cover, energy must be applied to lift the cover from its horizontal closed position to a vertical position, but gravity applies the necessary energy to move the cover from the vertical position to the horizontal open position.

Hatch covers are typically provided in sets of three or more. The hatch covers are hinged along one or both edges. In one embodiment, the edges of adjacent hatch covers are in close proximity, and a series of battens overlies the edges of adjacent covers to provide a seal between the edges. With this type of cover assembly, it is necessary to release and pivot the battens away from the hatch covers in a separate operation prior to opening the hatch cover. In another embodiment, the ends of adjacent covers overlap to provide the seal. Due to the overlapping arrangement, it is necessary to open the covers in a particular order.

With either type of cover assembly described above, the covers must be physically lifted by an operator standing on top of the railcar to open and close the covers. The covers are relatively heavy to lift, and the operator must walk across the top of the railcar to open each of the covers. Due to the height of the railcar and the weight of the covers, opening and closing the covers poses an injury risk.

U.S. Pat. No. 5,572,932 to Early describes a railcar hatch cover system in which adjacent covers are linked with a cable so that as one cover opens, it assists in opening the adjacent cover to which it is linked. With this system an operator must still walk across the top of the railcar to open each cover individually, although the system relieves the operator from lifting the full weight of each cover.

BRIEF SUMMARY OF THE INVENTION

The present invention is directed toward a railcar hatch cover assembly having at least first and second covers each moveable between an open position and a closed position. First and second gears are mounted to the first and second covers, respectively. Third and fourth gears are mounted to a shaft that rotates between first, second, third, and fourth positions in sequence. The third gear is engaged with the first gear as the shaft rotates from the first position to the third position, and the fourth gear is engaged with the second gear as the shaft rotates from the second position to the fourth position.

Preferably, the first cover is in the closed position when the shaft is in the first position, a partially open position when the shaft is in the second position, and an open position when the shaft is in the third position. The second cover is preferably in the closed position when the shaft is in the second position, a partially open position when the shaft is in the third position, and the open position when the shaft is in the fourth position. As the first cover moves from the partially open position to the open position the first cover applies a torque to the shaft that assists in rotating the shaft from the second position to the third position and moving the second cover from the closed position to a partially open position. Thus, less torque is needed to open the second cover because its opening is assisted by movement of the first cover. The hatch cover assembly may have any number of covers, which as they move from a partially open position to an open position assist in the opening of another cover. Because all of the covers are opened by a shaft, there is no need to open each cover individually. Instead, an operator may rotate the shaft to open all of the covers.

Preferably, the gears mounted to the cover include at least 180 degrees of gear surface that is mounted rigid to each cover around a cover pivot axis. The shaft is mounted parallel to the cover pivot axis. The shaft is positioned an appropriate distance from the cover pivot axis so that the shaft gears mesh with the cover gears. Each shaft gear preferably has approximately one less than one-half of the total number of teeth that the corresponding cover gear would have if it had teeth extending 360 degrees around its perimeter. For example, if the gear surface on the cover would have twelve teeth if it had teeth around its entire perimeter, the corresponding shaft gear has five teeth, or one less than one-half of twelve.

As the shaft is rotated to open the covers, a first set of shaft gears engages the cover gears of the first cover. As the shaft is rotated through about three teeth of the shaft gear, the first cover rotates to a vertical position. As the shaft is rotated further, a second set of shaft gears engages the cover gears of the second cover. At the same time, the first set of shaft gears remain engaged with the first cover gears. As the first cover falls from vertical to its horizontal, open position, it applies torque to the shaft. When the first cover is in its horizontal, open position, continued rotation of the shaft disengages contact between the first set of shaft gears and the first cover gears. At this time, a third set of shaft gears engages the third cover gears, while the second cover gears remain engaged with the second set of shaft gears such that torque is applied to the shaft as the second cover falls from a vertical position to an open, horizontal position. This process repeats for the number of covers that the system is intended to operate. Further, the process operates in a similar manner in reverse for closing the covers.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
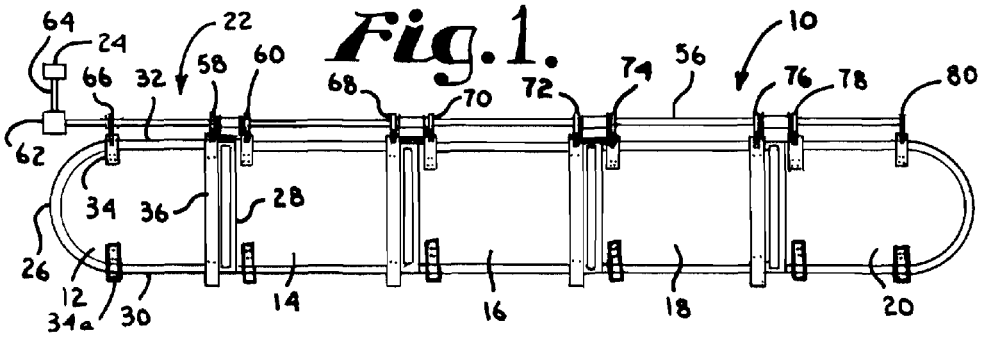
FIG. 1 is a top plan view of a hatch cover assembly in accordance with one embodiment of the present invention.

A hatch cover assembly in accordance with the present invention is shown generally in FIG. 1 as 10. Hatch cover assembly 10 is preferably mounted to the top of a railcar (not shown) adjacent an opening in the railcar to selectively cover the opening or permit access to the interior of the railcar through the opening. Hatch cover assembly 10 includes a first cover 12, a second cover 14, a third cover 16, a fourth cover 18, and a fifth cover 20. A cover operating assembly 22 described in detail below is mounted to the top of the railcar for opening and closing covers 12, 14, 16, 18, and 20 via rotation of a single socket 24 that is preferably aligned with the sidewall of the railcar. As described in detail below, the covers 12, 14, 16, 18, and 20 open in sequence and the cover operating assembly 22 is configured so that as the first of adjacent covers 12, 14, 16, 18, and 20 opens, the weight of the opening cover assists in opening the next cover.

First cover 12 includes opposed ends 26 and 28 and opposed sides 30 and 32. End 26 is rounded, while end 28 and sides 30 and 32 are substantially straight. Covers 14, 16, 18, and 20 also include opposed ends and opposed sides. Each of covers 14, 16, and 18 is substantially rectangular, while cover 20 is a mirror image of cover 12 with one rounded end. Covers 12, 14, 16, 18, and 20 are all approximately the same weight. A pair of hinges 34 and 36 are mounted to first cover 12 each adjacent one of ends 26 and 28. Each of the hinges 34 and 36 extends from a top surface of cover 12 beyond side 32. A tab 34*a* that is aligned with hinge 34 extends beyond side 30. Hinge 36 extends across cover 12 beyond side 30. In an alternative arrangement, tab 34*a* may be omitted and hinge 34 may extend beyond side 30 in a similar manner as hinge 36. The portion of tab 34*a* and hinge 36 extending beyond side 30 may be used to lock cover 12 as is known in the art. Each of covers 14, 16, 18, and 20 includes hinges similar to hinges 34 and 36 and a tab similar to tab 34*a*.

Figure 2:
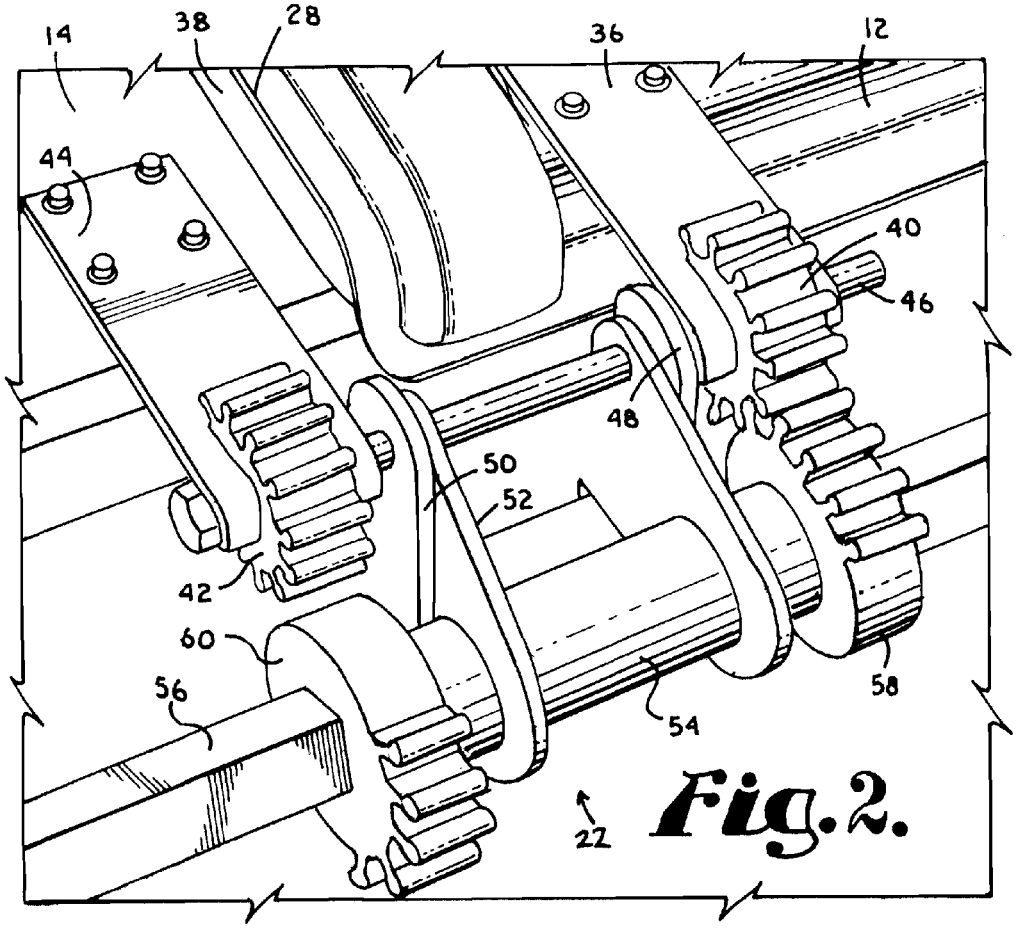
FIG. 2 is a perspective view of mating gears of the hatch cover assembly shown in FIG. 1.

End 28 of first cover 12 overlaps one end of second cover 14 when the covers are in a closed position, as shown in FIGS. 1 and 2. A seal 38 (FIG. 2) mounted to the underside of first cover 12 engages the top of second cover 14 to prevent moisture and contaminants from entering the railcar as is known in the art. An end of second cover 14 overlaps an end of third cover 16, an end of third cover 16 overlaps an end of fourth cover 18, and an end of fourth cover 18 overlaps an end of fifth cover 20. Seals (not shown) similar to seal 38 are joined to covers 14, 16 and 18. Because a portion of each of covers 12, 14, 16, and 18 overlaps the cover it is adjacent, the covers 12, 14, 16, 18, and 20 must be opened sequentially in order from first cover 12 to fifth cover 20 and must be closed sequentially in the reverse order.

Referring to FIG. 2, cover operating assembly 22 includes a gear 40 mounted to hinge 36 and a gear 42 that is mounted to a hinge 44, which is mounted on second cover 14 in a similar manner as hinge 34 (FIG. 1) of first cover 12. The end of hinge 36 to which gear 40 is mounted has an opening through which a bolt 46 is inserted. The other hinge 34 (FIG. 1) on first cover 12 includes a similar opening that receives a bolt (not shown). The first cover 12 is rotatable approximately 180 degrees around bolt 46 between the closed position shown in FIGS. 1 and 2 and the open position shown in FIG. 3B. Hinge 44 on second cover 14 includes an opening through which bolt 46 is inserted. The remainder of the hinges on covers 14, 16, 18, and 20 are formed in a similar manner as described above with respect to hinges 34, 36 and 44 to permit rotation of covers 14, 16, 18, and 20.

Figure 4A:
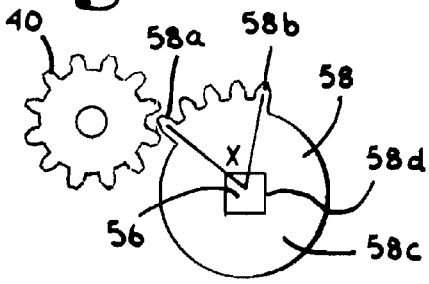
FIGS. 4A-4F show mating gears of the hatch cover assembly in different positions.

Bolt 46 extends through openings in a pair of brackets 48 and 50 that are mounted to the top of the railcar. Bolt extends through another pair of openings in a bracket assembly 52 that is joined to the top of the railcar. Bracket assembly 52 includes a tube 54 through which a shaft 56 is inserted. Tube 54 supports shaft 56 and allows rotation of shaft 56. Gears 58 and 60 are mounted to shaft 56. Gears 58 and 60 only have teeth extending from a portion of their perimeter. Referring to FIG. 4A, gear 58 is shown with five teeth, including a first tooth 58*a* and a last tooth 58*b*. The angle X between the first and last teeth is less than 360 degrees. The gear 58 has a central section 58*c* with a square shaped opening 58*d* that receives shaft 56. The teeth of gear 58 extend radially outward from central section 58*c*. As described in more detail below, when the teeth on gear 58 align with the teeth of gear 40, rotation of shaft 56 causes the gears 40 and 58 to engage each other and thereby move first cover 12. Likewise, when the teeth on gear 60 align with the teeth of gear 42, rotation of shaft 56 causes the gears 42 and 60 to engage each other and thereby move second cover 14.

Referring to FIG. 1, shaft 56 extends from a right angle gear box 62 adjacent the rounded end 26 of first cover 12 to the rounded end of fifth cover 20. Right angle gear box 62 receives another shaft 64 that is perpendicular to shaft 56. Socket 24 is mounted to an end of shaft 64. Right angle gear box 62 connects shafts 56 and 64 so that rotation of shaft 64 via socket 24 causes rotation of shaft 56. Two gears are mounted to shaft 56 for each of covers 12, 14, 16, 18, and 20. Gears 58 and 66, shown in FIG. 1, are mounted to shaft 56 for cover 12. Gear 58 mates with gear 40, as shown in FIG. 2, and gear 66 mates with a gear (not shown) mounted to cover 12 via hinge 34. The teeth on gears 58 and 66 are aligned so that they engage the gears on hinges 34 and 36 at the same time with rotation of shaft 56. Gears 60 and 68 are mounted to shaft 56 for cover 14, gears 70 and 72 are mounted to shaft 56 for cover 16, gears 74 and 76 are mounted to shaft 56 for cover 18, and gears 78 and 80 are mounted to shaft 56 for cover 20. Each of the gears 60, 68, 70, 72, 74, 76, 78 and 80 mate with a gear mounted to a hinge, similar to one of hinges 34 and 36, which is mounted to one of the covers 14, 16, 18, and 20. Gears 60 and 68 have aligned teeth, like the gears 58 and 66 for cover 12, so that they engage the teeth on the gears mounted to cover 14 at the same time. Gears 70 and 72 have aligned teeth for engaging the gears mounted to cover 16 at the same time, gears 74 and 76 have aligned teeth for engaging the gears mounted to cover 18 at the same time, and gears 78 and 80 have aligned teeth for engaging the gears mounted to cover 20 at the same time.

When all of the covers 12, 14, 16, 18, and 20 are closed, gear 58 is in approximately the position shown in FIGS. 2 and 4A such that the first tooth 58*a* on gear 58 is adjacent the teeth of gear 40 and will engage gear 40 as shaft 56 rotates in a counter-clockwise direction as viewed in FIG. 4A. As shown in FIG. 2, the teeth on gear 60 are offset from the teeth on gear 58 so that shaft 56 must be rotated counterclockwise before gear 60 will engage gear 42. The teeth on gears 58 and 66 adjacent first cover 12 are offset from the teeth on gears 60 and 68 adjacent second cover 14 by an amount such that when shaft 56 has been rotated to move the first cover 12 from the closed horizontal position shown in FIG. 1 ninety degrees to the vertical position shown in FIG. 3A, the teeth on gears 60 and 68 begin to engage the teeth on the gears mounted to second cover 14. The teeth on gears 70 and 72 adjacent third cover 16 are offset from the teeth on gears 60 and 68 adjacent second cover 14 by an amount such that when shaft 56 has been rotated to move the second cover 14 from the closed horizontal position shown in FIG. 1 to the vertical position shown in FIG. 3B, the teeth on gears 70 and 72 begin to engage the teeth on the gears mounted to the third cover 16. The teeth on gears 74 and 76 adjacent fourth cover 18 are offset from the teeth on gears 70 and 72 adjacent third cover 16 by an amount such that when shaft 56 has been rotated to move the third cover 16 to a vertical position, the teeth on gears 74 and 76 begin to engage the teeth on the gears mounted to the fourth cover 18. The teeth on gears 78 and 80 adjacent fifth cover 20 are offset from the teeth on gears 74 and 76 adjacent fourth cover 18 by an amount such that when shaft 56 has been rotated to move the fourth cover 18 to a vertical position, the teeth on gears 78 and 80 begin to engage the teeth on the gears mounted to the fifth cover 20.

Figure 3A:
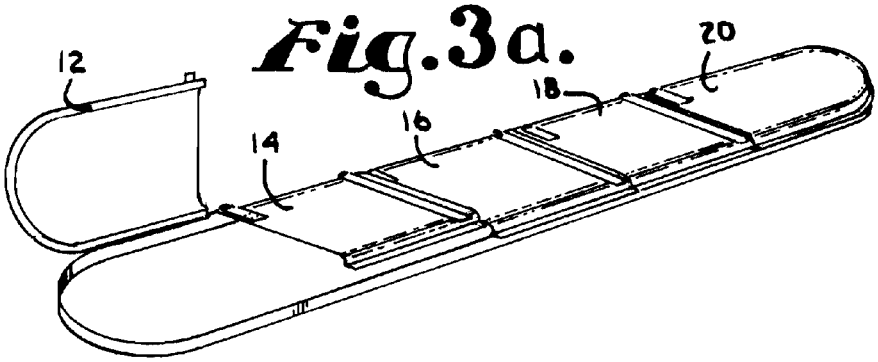
FIG. 3A is a perspective view showing one cover of the hatch cover assembly in a partially open position.
Figure 3B:
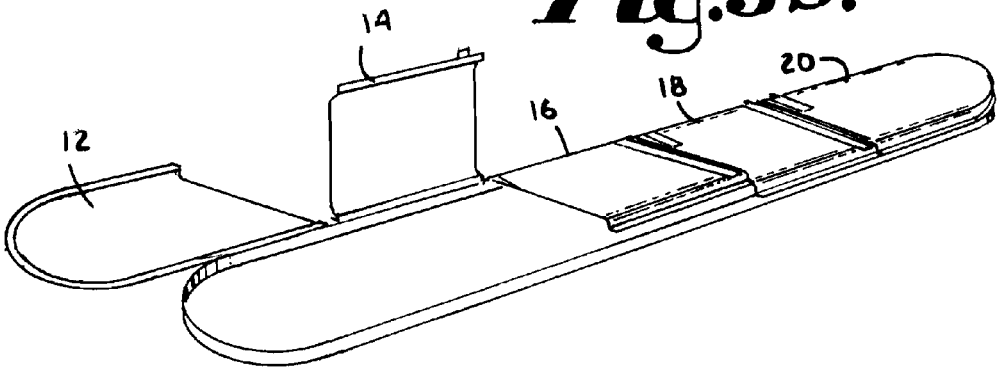
FIG. 3B is a perspective view showing one cover of the hatch cover assembly in an open position and the next cover in a partially open position.

As the first cover 12 moves from the partially open, vertical position shown in FIG. 3A to the open, horizontal position shown in FIG. 3B, gear 40 (FIG. 2) successively engages the final teeth of gear 58. The energy of the first cover 12 as it falls from the vertical position to the open, horizontal position is at least partially transferred to shaft 56 as torque via gears 40 and 58 to assist in rotating shaft 56 and opening second cover 14 to the partially open, vertical position shown in FIG. 3B. Once first cover 12 is in the open, horizontal position shown in FIG. 3B, continued rotation of shaft 56 disengages the final tooth of gear 58 from gear 40, as shown in FIG. 4*c*, to allow continued rotation of shaft 56. Likewise, as second cover 14 moves from a vertical position to an open, horizontal position, it assists in opening third cover 16, as third cover 16 moves from a vertical position to an open, horizontal position, it assists in opening fourth cover 18, and as fourth cover 18 moves from a vertical position to an open, horizontal position, it assists in opening fifth cover 20. Thus, after first cover 12 is opened to the vertical position shown in FIG. 3A, less torque is required to be input into shaft 56 to open the remainder of covers 14, 16, 18, and 20 because each of covers 12, 14, 16 and 18 assists in opening the next cover 14, 16, 18, and 20, respectively.

When all of the covers 12, 14, 16, 18, and 20 are in the open position, they are moveable to the closed position in reverse of the sequence described above. Thus, to move the covers 12, 14, 16, 18, and 20 from the open to the closed position, shaft 56 is rotated in the opposite direction as it is rotated to move the covers from the closed position to the open position. As the shaft 56 is rotated to close the covers, cover 20 first moves from the horizontal open position to a vertical position. As cover 20 moves from the vertical position to the horizontal closed position, it applies torque to the shaft 56 that assists in moving cover 18 from the horizontal open position to a vertical position. As the shaft 56 continues to rotate, covers 16, 14, and 12 move from the open position to the closed position in a similar manner until all of the covers are closed.

In one preferred embodiment, gears 40 and 42 (FIG. 2) and all of the gears mounted to the covers 12, 14, 16, 18, and 20 have 12 teeth. Gears 58, 60, 66, 68, 70, 72, 74, 76, 78, and 80 have teeth that are the same size as the teeth on gears 40 and 42 and spaced apart the same as the teeth on gears 40 and 42, but the gears 58, 60, 66, 68, 70, 72, 74, 76, 78, and 80 have a larger diameter than gears 40 and 42. If gears 58, 60, 66, 68, 70, 72, 74, 76, 78, and 80 had teeth extending around their entire perimeter, each gear would have 20 teeth. Each of the covers 12, 14, 16, 18, and 20 rotates approximately 180 degrees from a generally horizontal closed position to a generally horizontal open position. Each of the covers 12, 14, 16, 18, and 20 is shown closed in FIG. 1, and cover 12 is shown open in FIG. 3B. Each of the gears mounted to the covers 12, 14, 16, 18, and 20, such as gears 40 and 42 shown in FIG. 2, also rotates 180 degrees, or through six of its twelve teeth, as the respective cover moves from the closed position to the open position.

Each of the covers 12, 14, 16, 18, and 20, along with the gears mounted to them, rotates 90 degrees, or through three of twelve gear teeth, as the cover moves from the closed position to a vertical position, like the position of cover 12 in FIG. 3A. Shaft 56 rotates approximately 54 degrees in order to rotate any of the covers 12, 14, 16, 18, or 20 ninety degrees due to the larger diameter of the gears on shaft 56 versus the gears on covers 12, 14, 16, 18, and 20. Thus, from the position shown in FIG. 2, as shaft 56 rotates 54 degrees, three of the teeth on gear 58 successively engage the teeth of gear 40 to rotate the first cover 12 ninety degrees from the closed horizontal position to the vertical position shown in FIG. 3A. The offset between the teeth on gears 58 and 66 adjacent first cover 12 and the teeth on gears 60 and 68 adjacent second cover 14 is approximately 54 degrees, such that when first cover 12 reaches the vertical position, gears 60 and 68 begin to engage the gears mounted to second cover 14. Each of the offsets between the teeth on gears 60 and 68 and the teeth on gears 70 and 72, the teeth on gears 70 and 72 and the teeth on gears 74 and 76, and the teeth on gears 74 and 76 and the teeth on gears 78 and 80 is also approximately 54 degrees so that when the first of adjacent covers 12, 14, 16, and 18 reaches a vertical position, the next cover 14, 16, 18, and 20 begins to open. As each of the covers 12, 14, 16, and 18 begins to fall from the vertical position to the open horizontal position, the teeth on the gears mounted to the falling cover successively engage the final two teeth of the adjacent gears mounted to shaft 56, which transmits torque to shaft 56 and assists in opening the next cover.

Figure 4B:
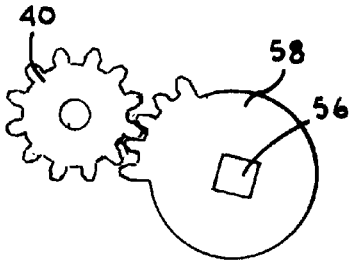
Figure 4C:
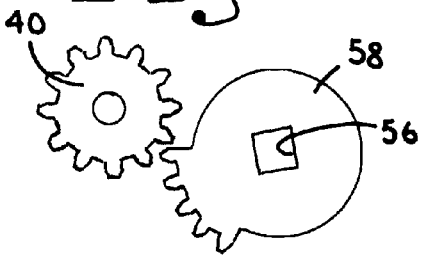
Figure 4D:
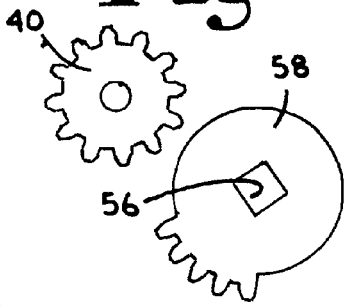
Figure 4E:
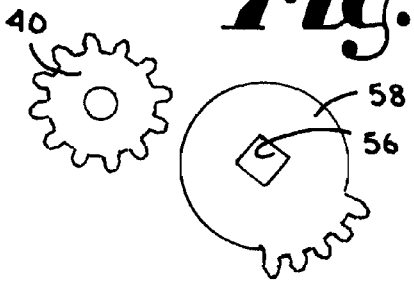
Figure 4F:
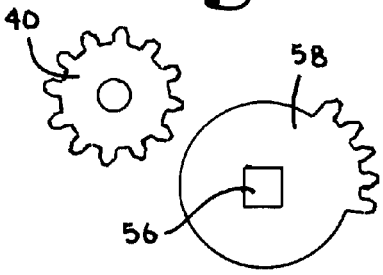

FIGS. 4A-4F show different positions of gears 40 and 58 as the shaft 56 to which gear 58 is mounted rotates between different positions. FIG. 4A shows a first position of the gears 40 and 58 and shaft 56 in which all of the covers 12, 14, 16, 18, and 20 are closed. FIG. 4B shows a second position of shaft 56 in which cover 12 is in a partially open, vertical position. FIG. 4C shows a third position of shaft 56 in which cover 12 is in a horizontal open position and cover 14 is in a partially open, vertical position. FIG. 4D shows a fourth position of shaft 56 in which covers 12 and 14 are in an open position and cover 16 is in a partially open, vertical position. FIG. 4E shows a fifth position of shaft 56 in which covers 12, 14, and 16 are in an open position and cover 18 is in a partially open, vertical position. FIG. 4F shows a sixth position of shaft 56 in which each of the covers 12, 14, 16, 18, and 20 is in an open position. Shaft 56 has been rotated through three of the teeth on gear 58, or approximately 30 degrees, between each of the first through fifth positions. Between the fifth position and sixth position, shaft 56 has been rotated through five of the teeth on gear 58, or approximately 54 degrees.

Figure 5:
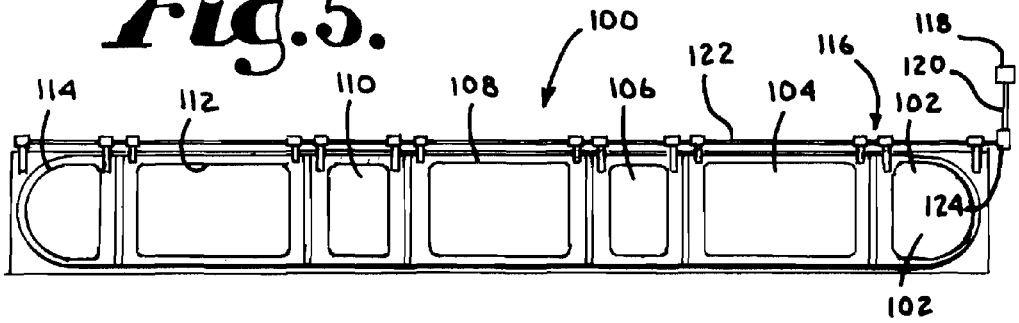
FIG. 5 is a top plan view of another embodiment of hatch cover assembly in accordance with the present invention.
Figure 6A:
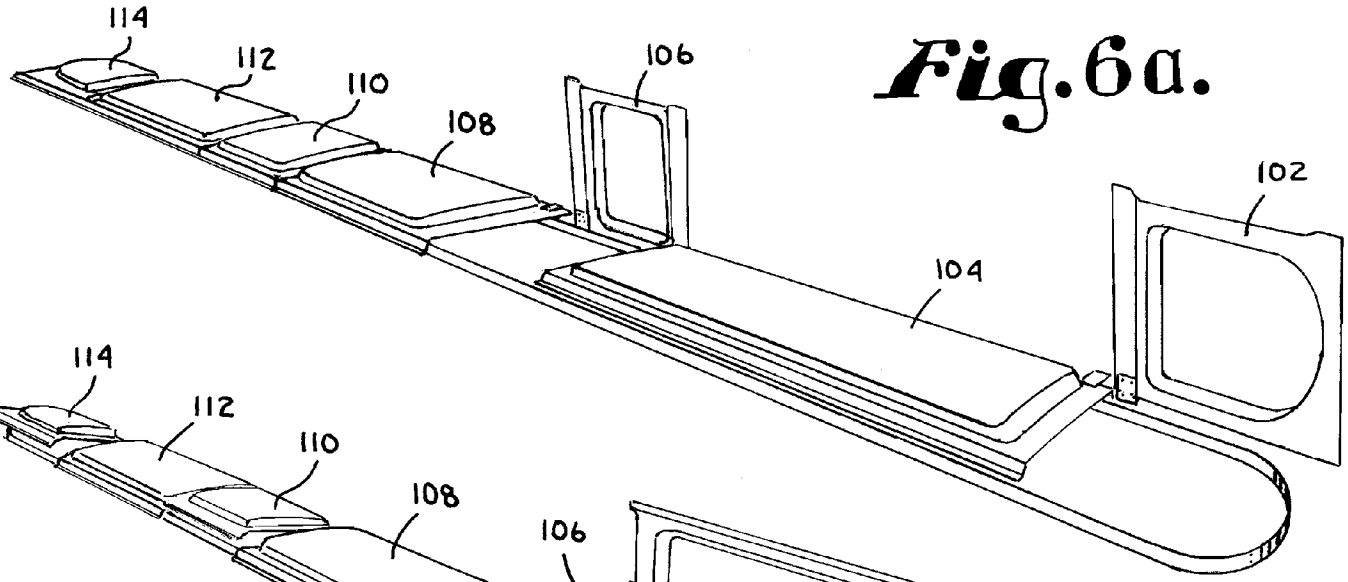
FIGS. 6A-6D are perspective views showing the cover opening sequence of the hatch cover assembly shown in FIG. 5.
Figure 6B:
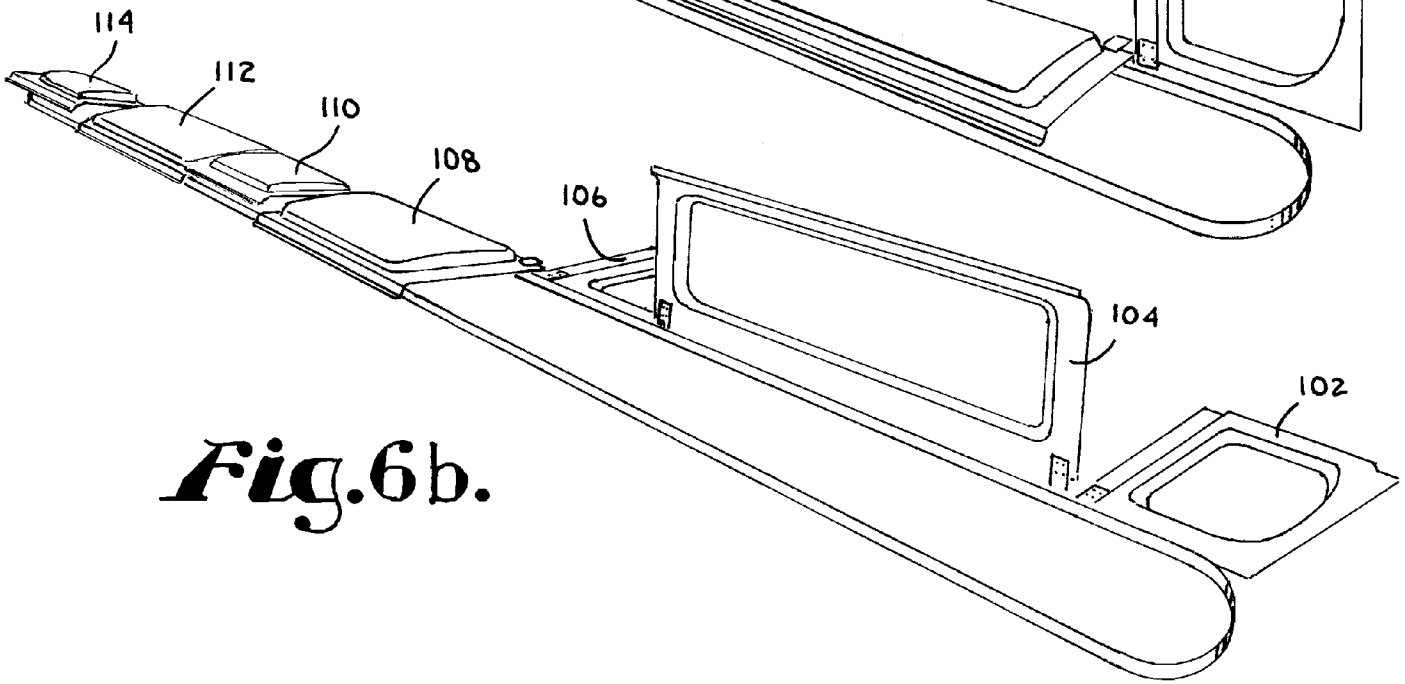
Figure 6C:
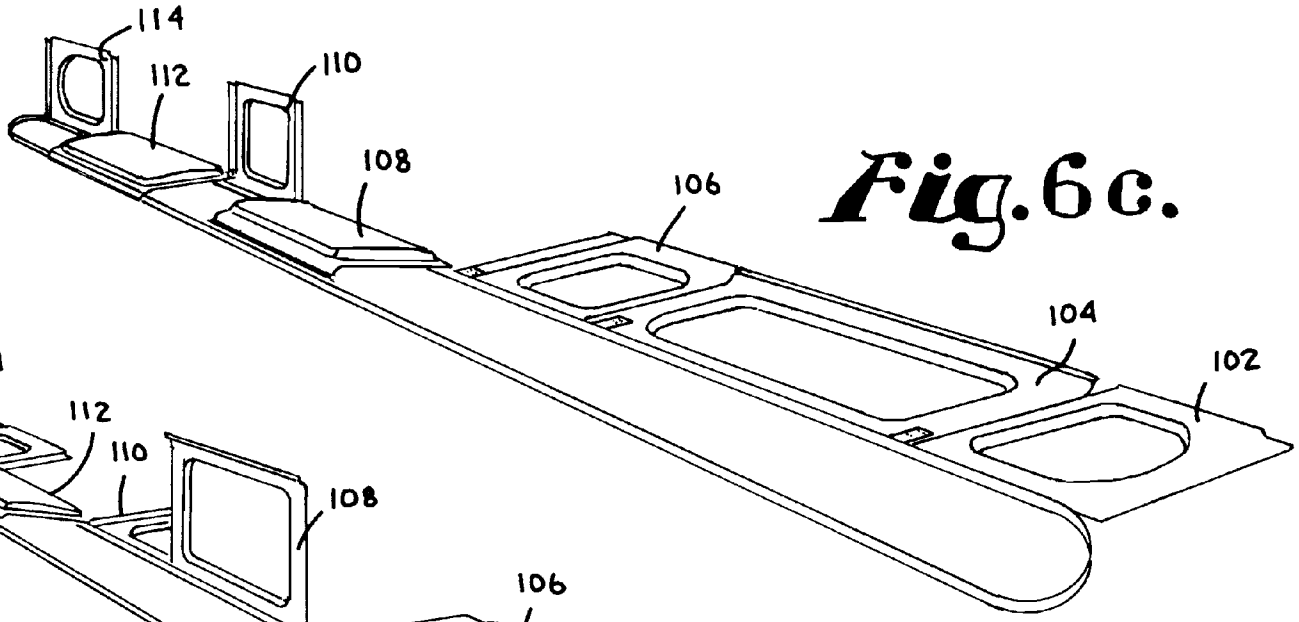
Figure 6D:
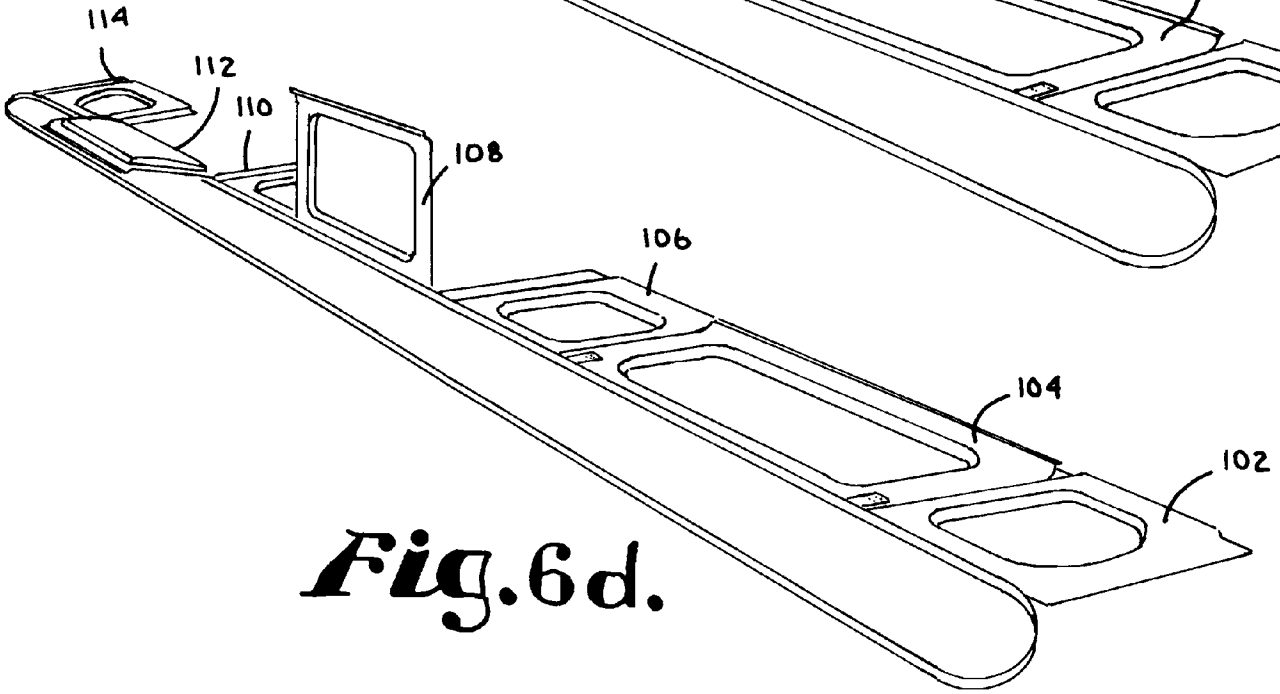

Referring now to FIGS. 5-6D, an alternative embodiment of hatch cover assembly is shown as 100. Hatch cover assembly 100 includes first, second, third, fourth, fifth, sixth, and seventh covers 102, 104, 106, 108, 110, 112, and 114, respectively. Hatch cover assembly 100 includes a cover operating assembly 116 that is similar to the cover operating assembly 22 of the hatch cover assembly 10 described above. The cover operating assembly 116 includes a socket 118, and shafts 120 and 122 joined by a right angle gear box 124. A hinge is mounted to each end of each of the covers 102, 104, 106, 108, 110, 112, and 114, and a gear is mounted to each of the hinges in a similar manner as described above for hatch cover assembly 10. A gear is mounted to shaft 122 adjacent each of the gears mounted to covers 102, 104, 106, 108, 110, 112, and 114 such that there are two gears on shaft 122 for each cover. The gears mounted to shaft 122 only include gear teeth around a portion of their perimeter in a similar manner as described above for the gears on shaft 56 of hatch cover assembly 10.

The covers 102, 104, 106, 108, 110, 112, and 114 of hatch cover assembly 100 differ from the covers of hatch cover assembly 10 because covers 102, 106, 110, and 114 are each approximately half the size and weight of covers 104, 108, and 112. Further, the ends of covers 102 and 106 overlap the ends of cover 104 such that covers 102 and 106 must be opened before cover 104. Similarly, the ends of covers 106 and 110 overlap the ends of cover 108, and the ends of covers 110 and 114 overlap the ends of cover 112.

The teeth on the gears that are mounted to shaft 122 adjacent first and third covers 102 and 106 are aligned so that covers 102 and 106 open and close at the same time. The teeth on the gears that are mounted to shaft 122 adjacent second cover 104 are offset from the teeth on the gears adjacent first and third covers 102 and 106 by an amount such that when the first and third covers 102 and 106 move from the closed horizontal position shown in FIG. 5 ninety degrees to the partially open, vertical position shown in FIG. 6A, second cover 104 begins to open. The teeth on the gears that are mounted to shaft 122 adjacent fifth and seventh covers 110 and 114 are aligned so that covers 110 and 114 open and close at the same time. The teeth on the gears adjacent fifth and seventh covers 110 and 114 are offset from the teeth on the gears adjacent second cover 104 by an amount such that when the second cover 104 moves from the closed horizontal position shown in FIG. 6A to the vertical position shown in FIG. 6B, fifth and seventh covers 110 and 114 begin to open. The teeth on the gears mounted to shaft 122 adjacent fourth cover 108 are offset from the teeth on the gears adjacent fifth and seventh covers 110 and 114 by an amount such that when the fifth and seventh covers 110 and 114 move to the vertical position shown in FIG. 6C, fourth cover 108 begins to open. The teeth on the gears mounted to shaft 122 adjacent sixth cover 112 are offset from the teeth on the gears adjacent fourth cover 108 by an amount such that when the fourth cover 108 moves to the vertical position shown in FIG. 6D, sixth cover 112 begins to open.

The weight of first and third covers 102 and 106 is approximately equal to the weight of cover 104 such that as first and third covers 102 and 106 fall from the vertical position shown in FIG. 6A to the open, horizontal position shown in FIG. 6B, the energy of the falling covers is at least partially transferred to shaft 122 as torque to assist in opening second cover 104 to the vertical position. Likewise, as second cover 104 moves from the vertical position shown in FIG. 6B to the open, horizontal position shown in FIG. 6C, it assists in opening fifth and seventh covers 110 and 114. As fifth and seventh covers 110 and 114 move from the vertical position shown in FIG. 6C to the open, horizontal position shown in FIG. 6D, they assist in opening fourth cover 108. As fourth cover 108 moves from the vertical position shown in FIG. 6D to an open, horizontal position, it assists in opening sixth cover 112. The covers 102, 104, 106, 108, 110, 112, and 114 move from the open position to the closed position in reverse of the order described above.

The hatch cover assemblies 10 and 100 shown in the drawings and described above are exemplary only. Either of the hatch cover assemblies 10 and 100 may have more or less than the number of covers described above. The pitch diameters, number of teeth on the gears, and gear ratio between the gears mounted to the covers and the gears mounted to the shaft used in the hatch cover assemblies 10 and 100 may be different from those described above depending on the number of covers used in the assembly. The cover opening sequence for either of the hatch cover assemblies 10 and 100 may also be different from that described above depending on the size and weight of the covers and on the manner in which covers overlap each other. The hatch cover assembly 100 may be configured so that all of the smaller covers 102, 106, 110, and 114 open prior to the larger covers 104, 108, and 112 so that an operator may only open one or more of the smaller covers 102, 106, 110, and 114 if desired. Further, any of the covers of the hatch cover assemblies 10 and 100 may include an opening and another smaller cover that is moveable from a closed position covering the opening to an open position. The smaller covers may be opened independently from the main covers, or prior to opening to main covers.

In operation, hatch cover assembly 10 may be utilized to access the interior of a covered railcar. To open covers 12, 14, 16, 18, and 20, an opening tool is inserted into socket 24 and rotated to rotate socket 24 and shafts 56 and 64. As shaft 56 rotates, each of the covers 12, 14, 16, 18, and 20 opens in succession such that the first of adjacent covers 12, 14, 16, and 18 to begin opening reaches a vertical position before the next cover 14, 16, 18, and 20 begins to open. As that first cover falls to an open, horizontal position, it transmits torque to shaft 56 which assists in opening the next cover to a vertical position. To move the covers from the open position to the closed position, the shaft 56 is rotated in the opposite direction as it is rotated to open the covers. The covers close in reverse order of the manner in which they open, and as each cover closes it assists in closing the cover it is adjacent. Hatch cover assembly 100 operates in a similar manner as hatch cover assembly 10 except that the covers open in a different sequence as set forth above.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A railcar hatch cover assembly comprising:

first and second covers each moveable between an open position and a closed position;

a first gear mounted to the first cover;

a second gear mounted to the second cover;

a shaft extending from adjacent the first gear to adjacent the second gear, wherein the shaft rotates between first, second, third, and fourth positions in sequence;

a third gear mounted to the shaft, wherein the third gear is engaged with the first gear as the shaft rotates from the first position to the third position; and a fourth gear mounted to the shaft, wherein the fourth gear is engaged with the second gear as the shaft rotates from the second position to the fourth position.

2. The railcar hatch cover assembly of claim 1, wherein the first cover is in the closed position when the shaft is in the first position, wherein the first cover is in the open position when the shaft is in the third position, wherein the second cover is in the closed position when the shaft is in the second position, and wherein the second cover is in the open position when the shaft is in the fourth position.

3. The railcar hatch cover assembly of claim 2, wherein the first cover is in a partially open position when the shaft is in the second position, wherein as the first cover moves from the partially open position to the open position the first cover applies a torque to the shaft that assists in rotating the shaft from the second position to the third position and moving the second cover from the closed position to a partially open position.

4. The railcar hatch cover assembly of claim 3, wherein the first cover is substantially horizontal in the open and closed positions, and wherein the first cover is substantially vertical in the partially open position.

5. The railcar hatch cover assembly of claim 3, wherein the first cover rotates approximately 90 degrees from the closed position to the partially open position, and wherein the first cover rotates approximately 90 degrees from the partially open position to the open position.

6. The railcar hatch cover assembly of claim 3, further comprising:

a third cover moveable between a closed position and an open position;

a fifth gear mounted to the third cover; and a sixth gear mounted to the shaft, wherein the sixth gear is engaged with the fifth gear as the shaft rotates from the third position to a fifth position, and wherein the fourth position is between the third position and the fifth position.

7. The railcar hatch cover assembly of claim 6, wherein the third cover is in the closed position when the shaft is in the third position, and wherein the third cover is in the open position when the shaft is in the fifth position.

8. The railcar hatch cover assembly of claim 7, wherein the second cover is in a partially open position when the shaft is in the third position, wherein as the second cover moves from the partially open position to the open position the second cover applies a torque to the shaft that assists in rotating the shaft from the third position to the fourth position and moving the third cover from the closed position to a partially open position.

9. The railcar hatch cover assembly of claim 6, wherein the first cover is positioned between the second and third covers, and wherein the first cover partially overlaps each of the second and third covers when the first, second, and third covers are in their closed positions.

10. The railcar hatch cover assembly of claim 6, wherein the first cover partially overlaps the second cover when the first and second covers are in their closed positions, and wherein the second cover partially overlaps the third cover when the second and third covers are in their closed positions.

11. The railcar hatch cover assembly of claim 1, wherein each of the first and second covers comprises opposing sides and opposing ends, wherein one end of the first cover is adjacent one end of the second cover, and wherein each of the first and second covers rotates from the closed position to the open position about an axis that is substantially parallel to one of the sides of the respective cover.

12. The railcar hatch cover assembly of claim 1, wherein each of the third and fourth gears comprises a central section with an opening that receives the shaft, and a set of teeth extending radially outward from the central section, wherein the set of teeth of each of the third and fourth gears comprises first and last teeth with an angle between them of less than 360 degrees, and wherein the set of teeth on the third gear is offset from the set of teeth on the fourth gear by a non-zero angle.

* * * * *